US008555578B2

(12) United States Patent
Hushek

(10) Patent No.: US 8,555,578 B2
(45) **Date of Patent: *Oct. 15, 2013**

(54) SHIELDED MOVABLE DOOR ELEMENT OF A MULTIMODALITY MEDICAL SUITE

(75) Inventor: Stephen G. Hushek, Wauwatosa, WI (US)

(73) Assignee: MedTrak Holding Company, LLC, Wauwatosa, WI (US)

( * ) Notice: Subject to any disclaimer, the term of this patent is extended or adjusted under 35 U.S.C. 154(b) by 283 days.

This patent is subject to a terminal disclaimer.

(21) Appl. No.: 13/092,643

(22) Filed: Apr. 22, 2011

(65) Prior Publication Data

US 2012/0266541 A1 Oct. 25, 2012

(51) Int. Cl.
*E04H 1/00* (2006.01)

(52) U.S. Cl.
USPC ..... 52/238.1; 49/168; 5/85.1

(58) Field of Classification Search
USPC ..... 52/243.1, 238.1; 5/81.1 R, 85.1, 87.1; 49/163, 168–171
See application file for complete search history.

(56) References Cited

U.S. PATENT DOCUMENTS

| | | | |
|---|---|---|---|
| 5,259,011 | A | 11/1993 | Petro |
| 5,573,000 | A | 11/1996 | Goffer et al. |
| 5,986,531 | A | 11/1999 | Carrozzi |
| 6,195,578 | B1 | 2/2001 | Distler et al. |
| 6,232,548 | B1 | 5/2001 | Eberler et al. |
| 6,498,947 | B2 | 12/2002 | Boskamp et al. |
| 6,882,547 | B2 | 4/2005 | Arz |
| 7,071,692 | B2 | 7/2006 | Branch et al. |
| 7,102,350 | B2 | 9/2006 | Weyers et al. |
| 7,157,911 | B2 | 1/2007 | Suzuki et al. |
| 7,246,681 | B2 | 7/2007 | Christen |
| 7,304,476 | B2 | 12/2007 | Vrinten et al. |
| 7,486,982 | B2 | 2/2009 | Branch et al. |
| 7,772,503 | B2 | 8/2010 | Ginanneschi |
| 7,796,403 | B2 | 9/2010 | Coakley |
| 7,834,626 | B2 | 11/2010 | Renz |
| 2003/0088175 | A1 | 5/2003 | Branch |
| 2005/0027189 | A1 | 2/2005 | Branch |
| 2006/0017536 | A1 | 1/2006 | Xu |
| 2007/0135704 | A1 | 6/2007 | Branch |
| 2007/0238950 | A1 | 10/2007 | Vija et al. |
| 2008/0039712 | A1 | 2/2008 | Graves et al. |
| 2008/0271242 | A1 | 11/2008 | Hjort |
| 2008/0281181 | A1 | 11/2008 | Manzione |
| 2009/0306494 | A1 | 12/2009 | Scarth et al. |

FOREIGN PATENT DOCUMENTS

| | | |
|---|---|---|
| WO | 2009036174 | 3/2009 |

OTHER PUBLICATIONS

PCT Search Report from PCT/US2012/052843 issued Dec. 26, 2012.
PCT Search Report from PCT/US2012/033889 issued Oct. 16, 2012.

*Primary Examiner* — Jeanette E Chapman
*Assistant Examiner* — Daniel Kenny
(74) *Attorney, Agent, or Firm* — Reinhart Boerner Van Deuren s.c.

(57) ABSTRACT

A movable door element in a door of a multimodality medical suite. The door is in a wall positioned between a first room and a second room of the suite, with the suite including a flexible raceway configured to extend within the length of the suite and selectively extend through a portion of the door, the door element including a housing and a shield component. The housing is coupled to the door and configured to selectively move from a first position to a second position. The housing is further configured to move to the second position when a shield door component, coupled to the raceway, displaces the housing and is disposed in a space in the portion of the door vacated by the door element. The shield component disposed in the housing.

35 Claims, 6 Drawing Sheets

SHIELDED MOVABLE DOOR ELEMENT OF A MULTIMODALITY MEDICAL SUITE

BACKGROUND OF THE INVENTION

Field of the Invention

The present disclosure is directed to medical equipment and more particularly to a patient transport apparatus movable between a first room and a second room of a multimodality medical suite.

Operating rooms will often feature sophisticated imaging systems such as magnetic resonance scanners, computed tomography scanners, or angiography systems to provide a physician with sub-surface visualization capabilities of the patient. Such equipment allows the physician to select an incision site more precisely and reduce the size of an incision during surgery or precisely target the anatomy of interest during a stereotactic procedure. The difficulties associated with locating these imaging systems in an operating room have led vendors to implement multi-room suites with patient transport systems to move the patient from the surgical/procedural/treatment environment to an imaging environment.

Of particular concern is when a patient is under anesthesia because of a risk associated with dislocation of the airway or the multitude of intravenous fluid lines and other invasive devices associated with anesthesia and patient monitoring. The anesthesiologist and their assistants are forced to walk alongside the patient during transport, manually rolling the anesthesia machine and patient monitoring system alongside the patient. Such personnel ensure that none of the tubes, or lines, or hoses get pulled or experience significant tension, while the gas lines, power cords, and data lines stretch progressively further from their connection points. Such situation also creates a trip and disconnect hazard. In some cases, the anesthesiologists are forced to disconnect the anesthesia machine from the gas ports in one room and reconnect them to different ports in the second room. During the transition or movement of the patient from one room to another an anesthesiologist, or an assistant, has to "bag" the patient. If multiple room-to-room transitions are required, the anesthesia disconnects and reconnects are, at the least, inconvenient and potentially dangerous.

An additional problem occurs when moving a patient into a magnetic resonance imaging (MRI) room because the radio frequency (RF) shielding doors must provide a complete seal to prevent electronic noise from getting into the MR room and corrupting the images. Thus, the doors must provide the seal when a diagnostic patient is being scanned and the anesthesia connections are not coming into the room, as well as when a surgical patient is being scanned and the anesthesia connections are coming into the room.

The apparatus of the present disclosure must also be of construction which is both durable and long lasting, and it should also require little or no maintenance to be provided by the user throughout its operating lifetime. In order to enhance the market appeal of the apparatus of the present disclosure, it should also be of inexpensive construction to thereby afford it the broadest possible market. Finally, it is also an objective that all of the aforesaid advantages and objectives be achieved without incurring any substantial relative disadvantage.

SUMMARY OF THE INVENTION

The disadvantages and limitations of the background art discussed above are overcome by the present disclosure.

A movable door element in a door of a multimodality medical suite. The door is a part of a wall positioned between a first room and a second room of the suite, with the suite including a flexible raceway configured to extend within the length of the suite between the rooms and selectively extend through a portion of the door, the door element including a housing and a shield component. The housing is coupled to the door and configured to selectively move from a first position to a second position. The housing is further configured to move to the second position when a shield door component, coupled to the raceway, replaces the housing and is disposed in a space in the portion of the door vacated by the door element. The shield component is disposed in the housing.

A method for maintaining shield integrity of a multimodality medical suite. The suite includes a first room and a second room separated by a wall having a door. The suite further includes a flexible raceway configured to extend within the length of the suite and selectively extend through a portion of the door. The method includes providing a door element, with the door element including a housing and a shield component. The housing is coupled to the door and configured to selectively move from a first position to a second position. The shield component is disposed in the housing. The method further provides a shield door component and coupling the shield door component to the flexible raceway. Positioning the shield door component along the flexible raceway so that the shield door component moves the housing from the portion of the door when the flexible raceway is extended between the two rooms of the suite. The shield door component is disposed in a space in the portion of the door vacated by the door element, wherein the shield integrity of the suite is maintained.

A movable door element in a door of a multimodality medical suite. The door is a part of a wall positioned between a first room and a second room of the suite, with the suite including a flexible raceway configured to extend within the length of the suite between the rooms and selectively extend through a portion of the door, the door element including a housing and a shield component. The housing is coupled to the door and configured to selectively move from a first position to a second position. The housing is further configured to move in response to the proximity of a shield door component coupled to the raceway and which replaces the housing and is disposed in a space in the portion of the door vacated by the door element. The shield component is disposed in the housing.

The apparatus of the present disclosure is of a construction which is both durable and long lasting, and which will require little or no maintenance to be provided by the user throughout its operating lifetime. The apparatus of the present disclosure is also of inexpensive construction to enhance its market appeal and to thereby afford it the broadest possible market. Finally, all of the aforesaid advantages and objectives are achieved without incurring any substantial relative disadvantage.

DESCRIPTION OF THE DRAWINGS

These and other advantages of the present disclosure are best understood with reference to the drawings, in which.

DETAILED DESCRIPTION OF THE EXEMPLARY EMBODIMENTS

Figure 1:
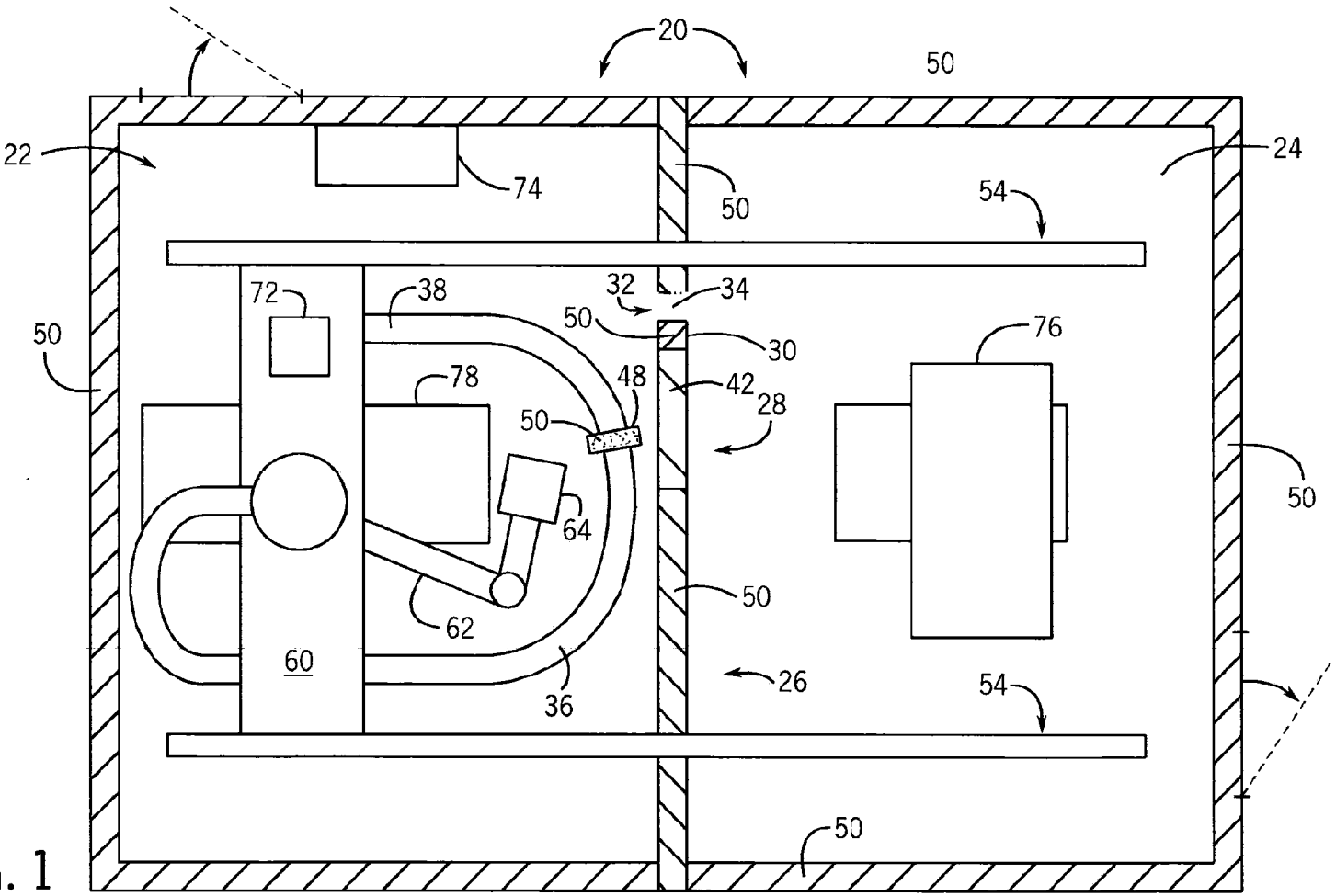
FIG. 1 is a schematic, top view of an exemplary embodiment of a multimodality medical suite, including a patient transport apparatus, track system, cable/hose management system and supporting carriage, with a wall having a door apparatus including a movable door element.
Figure 2:
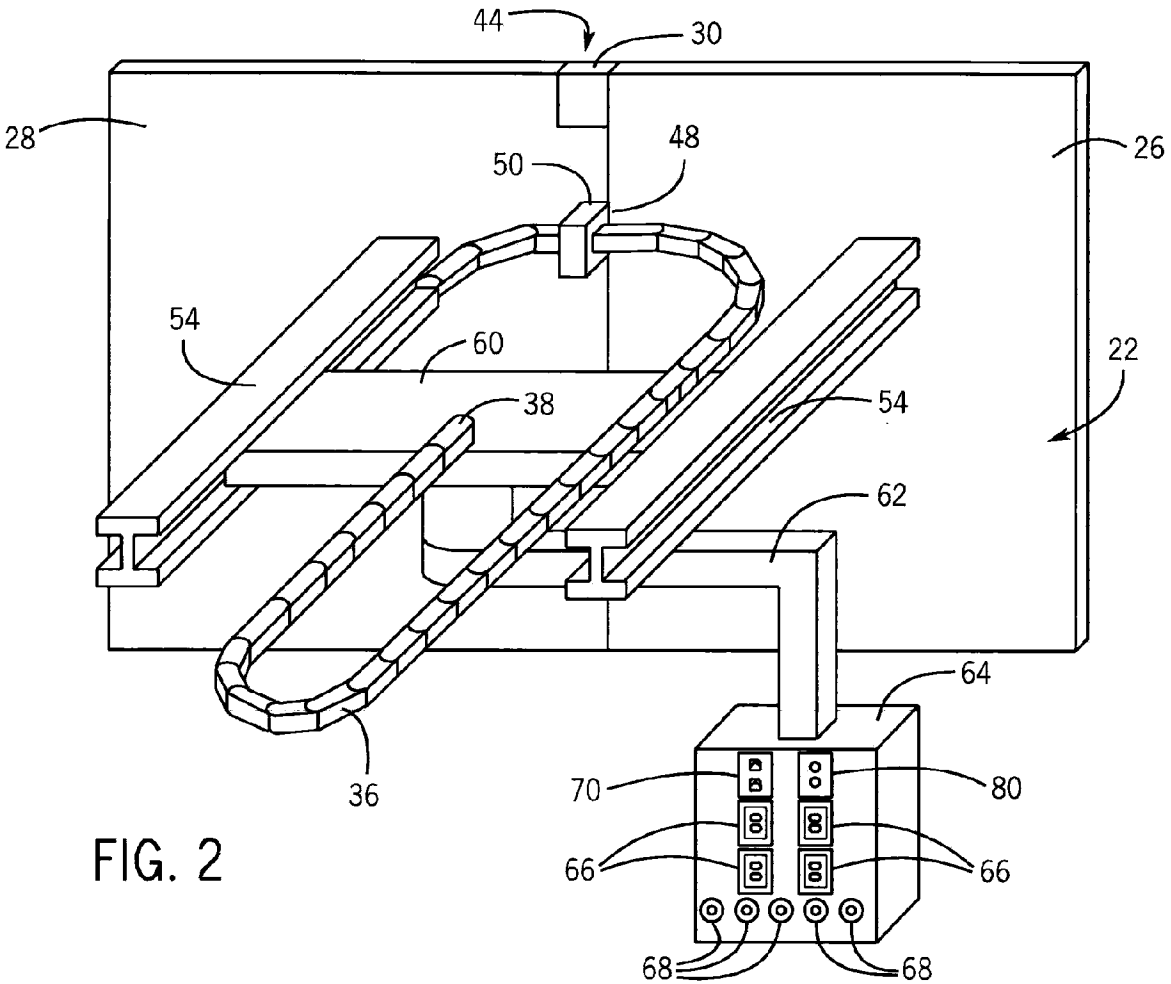
FIG. 2 is a schematic perspective view of the door element of FIG. 1 in a closed (first position) position in the wall between the first and second rooms of the suite, and the support carriage and cable/hose management system all within the first room of the suite.
Figure 3:
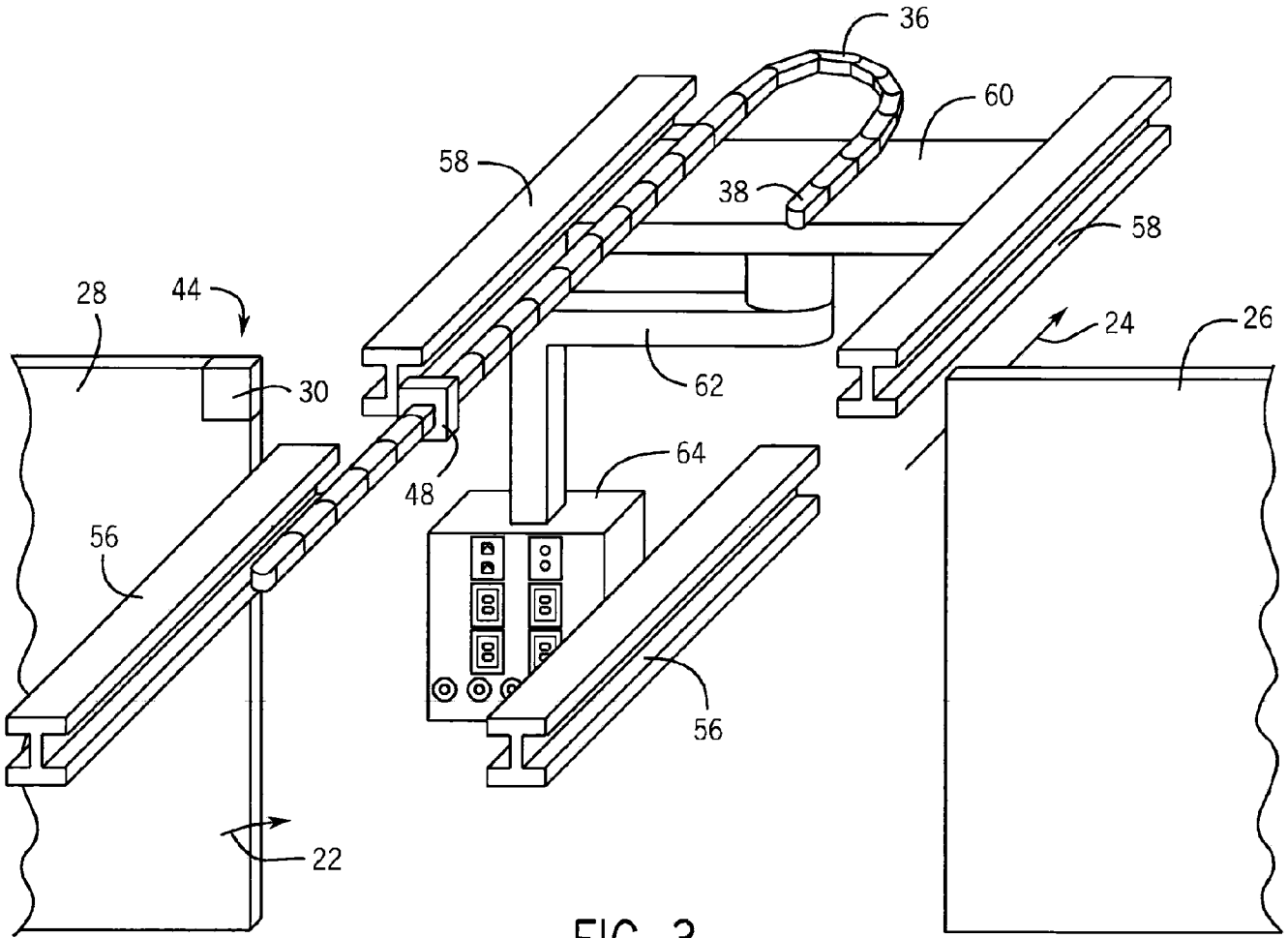
FIG. 3 is a schematic perspective view of the door apparatus of FIG. 1 in an open position with the support carriage and cable/hose management system extending into the second room of the suite.
Figure 4:
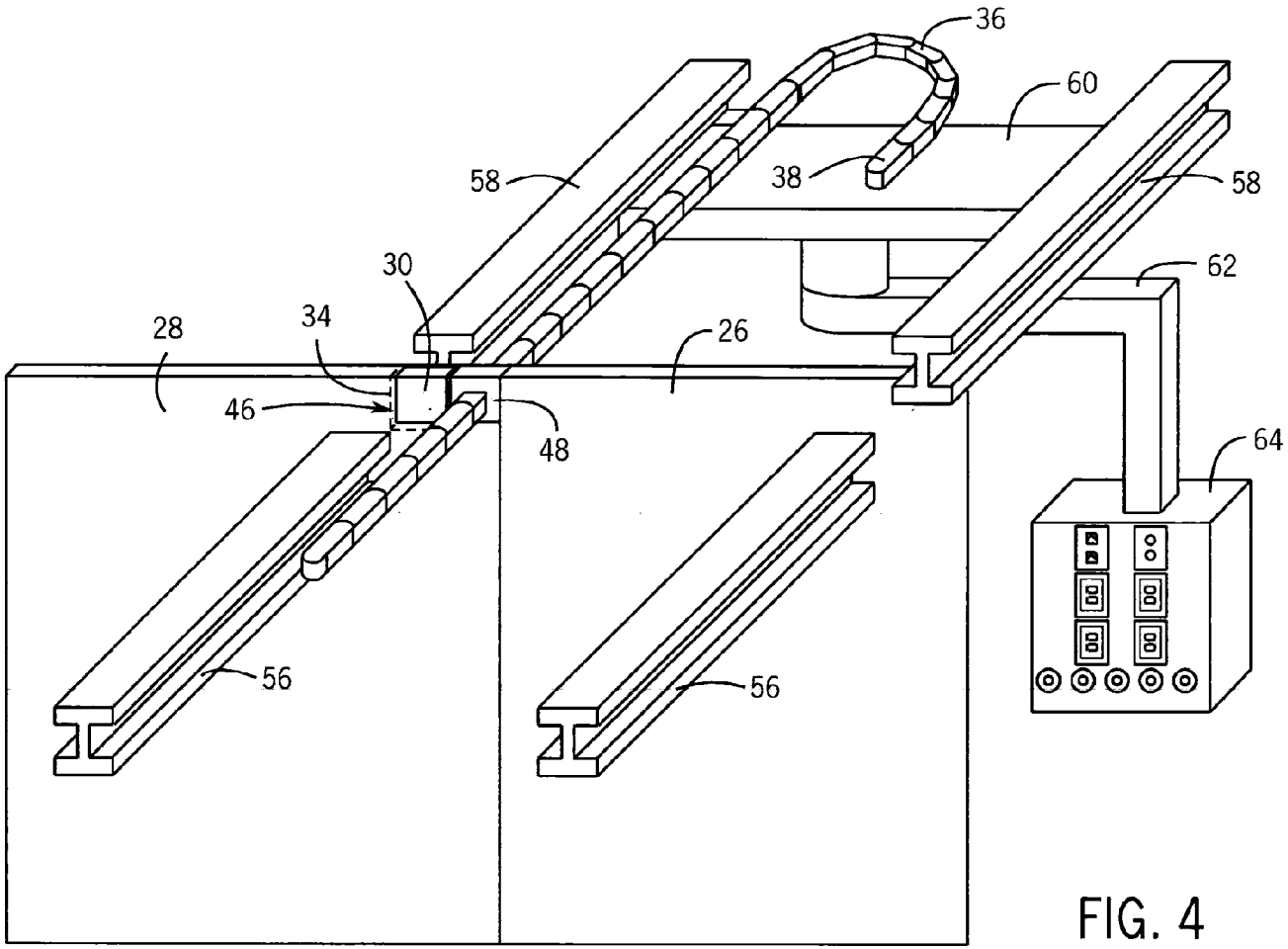
FIG. 4 is a schematic perspective view of the door apparatus of FIG. 1 in a closed position with the support carriage in the second room and the cable/hose management system extending within the first and second rooms of the suite, and the movable door element in a second position in a recess defined in the door.
Figure 5:
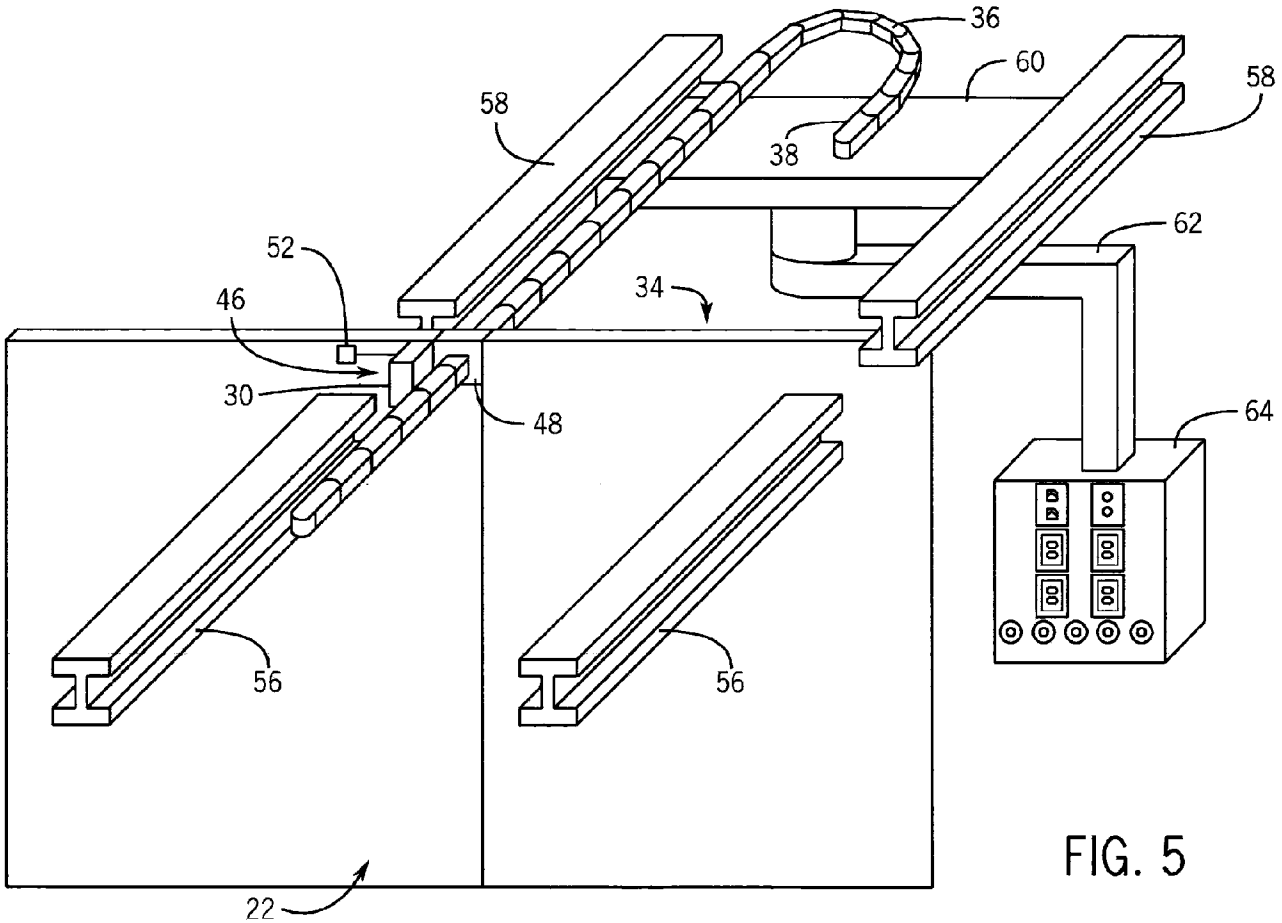
FIG. 5 is a schematic perspective view of the door apparatus of FIG. 1 in a closed position with the support carriage in the second room and the cable/hose management system extending within the first and second rooms of the suite, and the movable door element in a second position at least 90° relative to the door.

Referring to FIGS. 1-7, FIG. 1 illustrates a schematic, top view of an exemplary embodiment of a multimodality medical suite 20. The multimodality medical suite 20 includes a first room 22 and a second room 24 separated by a wall 26. The first room 22, for example, contains the surgical equipment 74 and the patient transport apparatus 78 and other appropriate medical treatment equipment, supplies, and related items. As described earlier, at times, the patient on the medical transport apparatus 78 may have to be moved to a medical imaging system. The second room 24 of the multimodality medical suite 20 includes a medical imaging system, for example, a magnetic resonance imaging system (MRI), a computed tomography scanner (CT), positron emission tomography (PET) or other types of medical imaging equipment 76.

Figure 6:
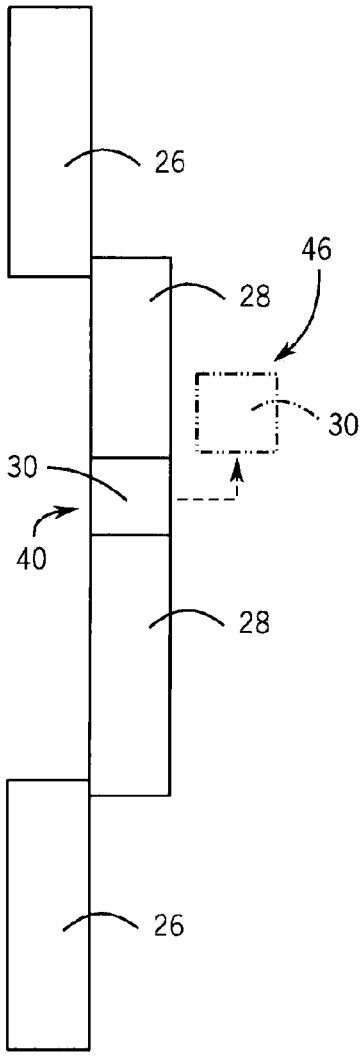
FIG. 6 is a schematic top view of the wall, doors and movable door element illustrated in FIG. 1 and illustrating the movable door element in a second position along side and substantially parallel to the door.
Figure 7:
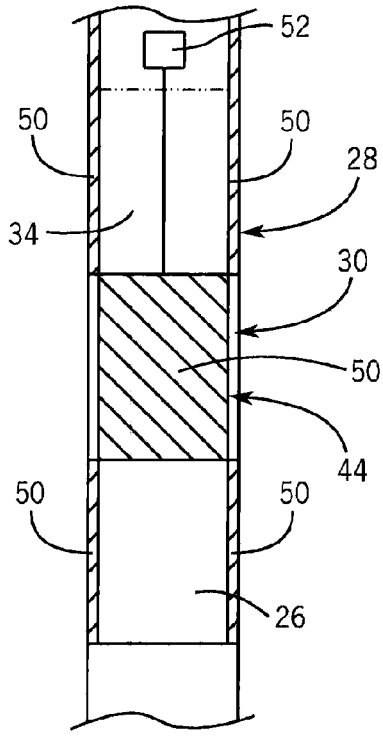
FIG. 7 is a top detail view of the movable door element illustrated in FIG. 1 in a closed position and coupled to an actuator configured to move the movable door element in and out of a recess defined in the door.

As disclosed and claimed herein, the wall 26 separating the first room 22 and the second room 24 of the multimodality medical suite 20 includes a door 28 which is configured to open to allow access between the rooms 22, 24 of the multimodality medical suite 20. FIG. 1 illustrates an example of a pocket door, FIG. 6 illustrates doors that move parallel to the wall 26. The multimodality medical suite 20 includes a flexible raceway 36 which functions as a cable/management system which is configured to extend within the length of the multimodality medical suite 20 and selectively extend through a portion 32 of the door 28.

A space 40 is defined in a portion of the door 32. The space 40 is configured to receive one of a movable door element 30 and a shield door component 48 as more fully described below. The movable door element 30 is mounted on the door 28 so that it is automatically displaced by the shield door component 48 coupled to the flexible raceway 36 or moved by an actuator 52 coupled to the movable door element 30.

The movable door element 30 includes a housing 32 which is coupled to the door 28 and configured to selectively move from a first position 44 to a second position 46. The housing 32 is further configured to move to the second position 46 when the shield door component 48, which is coupled to the flexible raceway 36, displaces the housing. The shield door component 48 is then disposed in the space in the portion of the door 32 vacated by the movable door element 30. The housing 32 also includes a shield component 50 disposed in the housing which assists in maintaining the shield integrity of the multimodality medical suite 20.

The movable door element 30, when in the first position 44 is positioned and functions as a part of the wall 26 of the multimodality medical suite 20. The movable door element, in the second position 46, can be in several different configurations as disclosed herein. In one configuration the movable door element 30, when in the second position, is at least 90 degrees relative to the door 28 (see at least FIG. 5). It is also contemplated that other suitable angles can be established in coordination with the movement of the door element 30, the flexible raceway 36, the door 28, and overall geometry of the multimodality medical suite 20. In another configuration, the movable door element 30 is in a second position that is alongside and substantially parallel to the door 28 (see FIG. 6). In another configuration, the movable door element 30 is configured to move to a second position in a recess 34 defined in one of the wall 26 and door 28 (see FIG. 7).

In some of the above-described configurations, an actuator 52 is coupled to the movable door element 30 and moves the door element 30 from the first to the second position and vice versa. The actuator is one of a spring, a pneumatic cylinder, a hydraulic cylinder, and a motor. A door control controller 72, in some configurations of the movable door element 30, is coupled to the actuator 52 to provide control commands to control the movement of the movable door element 30. In some configurations of the movable door element, the door 28 pushes the movable door element 30 into the recess 34 and an actuator moves the movable door element 30 out of the recess 34.

In an embodiment, the actuator moves the movable door element 30 from the first position 44 in response to the proximity of the shield door component 48. The proximity or distance between the shield door component 48 and the movable door element 30 will vary from suite to suite based on the particular geometry of the suite and its components. The proximity distance can be set by an operator with the controller described below. The controller 72 signals the actuator, for example an electric motor, to activate and move the door element 30. In another embodiment appropriately positioned sensors, for example optical or magnetic sensors, in, for example the door element 30 and shield door component, will provide a signal to an actuator to facilitate the movement of the door element 30.

As discussed above, the room volume of the multimodality medical suite 20 that contains the medical imaging equipment 76 must be shielded from various types of influences to properly function. Accordingly, the multimodality medical suite 20 walls typically include a shield component 50 that is selected from a group consisting of a radiation shield, (for example, foamed aluminum), a radiofrequency shield, (for example, a copper mesh), an acoustic shield, (for example, dimensional cork), a gas seal, (for example, appropriate gaskets), and a combination of any two such shield components.

The movable doors 28 and wall 26 separating the first and second rooms, 22, 24 of the multimodality medical suite 20 must also include a shield component 50. It follows that the movable door element 30 must also provide a shield function and therefore includes a shield component 50 disposed in the housing 42 of the movable door element 30. However, when the patient transport apparatus 78 moves from the first room 22 to the second room 24 including the flexible raceway 36, which passes through the space 40 in the portion of the door 32 (see FIGS. 3-5), shield integrity is compromised unless the shield door component 48 replaces the movable door element which now is in position two 46. The shield door component 48 which is coupled to the flexible raceway 36 provides the necessary shield function when the door 28 is closed and the flexible raceway 36 extends in both the first room 22 and second room 24 as illustrated in at least FIGS. 4 and 5 of this disclosure. As such the shield integrity of the multimodality medical suite 20 is maintained.

The shield door component 48 is positioned along the flexible raceway 36 so that the shield door component 48 either moves the housing from the portion of the door when the flexible raceway 36 is extended between the two rooms 22, 24 of the multimodality medical suite 20 and/or the shield door component 48 is positioned in the space 40 in the portion of the door 42 vacated by the movable door element 30 when the movable door element moves to its second position 46. As described above, the movement of the movable door element 30 from the first position 44 to the second position 46 can be accomplished by actuation of the actuator 52 or the force applied to the movable door element 30 by the door 28.

The multimodality medical suite 20 also includes a track system 54 extending within the first and second rooms 22, 24 of the multimodality medical suite 20. The track system 54 may be positioned in the floor of the multimodality medical suite 20, in the sidewalls of the multimodality medical suite 20, or in the ceiling of the multimodality medical suite 20. As illustrated in the figures, the track system is positioned in or near the ceiling of the multimodality medical suite 20.

In some configurations, the track system 54 may include multiple parts with one part 56 disposed in the first room 22 and a second part 58 of the track system 54 disposed in the second room 24. In the latter configuration, the gap between the track parts 56, 58 is at least the distance equal to the thickness of the wall 26 separating the two rooms 22, 24 of the multimodality medical suite 20.

The track system 54 is composed of material, for example metal or composite material, that is sufficiently strong and durable to support any equipment (some of which are described below) coupled to the track system 54. The track system 54 is also compatible and suitable with the medical treatment and medical imaging environment of the multimodality medical suite 20.

A support carriage 60 is coupled to the track system and configured to move between the first and second rooms 22, 24 of the multimodality medical suite 20. One end 38 of the flexible raceway is coupled to the support carriage 60. The support carriage 60 is further configured to span the gap between the track portions 56, 58 so that motion of the support carriage 60 is not impeded when moving between the first and second rooms 22, 24 of the multimodality medical suite 20.

The support carriage 60 can be articulated by a motor, for example an electric motor, or manually by medical personnel. The support carriage 60 is provided with appropriate motive support devices, for example wheels or slats with a slippery surface, configured to smoothly and efficiently allow the support carriage 60 to move along the track system 54, including spanning a gap in the track system 54 if necessary. The support carriage 60 and track system 54 are appropriately grounded electrically to prevent sparking or electrical discharge as a result of movement of the support carriage 60.

Coupled to the support carriage 60 is a medical treatment equipment boom 62 which is also coupled to the flexible raceway 36 and configured to move between the first and second rooms 22, 24 of the multimodality medical suite 20 with the support carriage 60. In one embodiment, a medical equipment interface console 64 is coupled to the medical treatment equipment boom 62 with the medical equipment interface console 64 further coupled to electrical, fluid, and data conduits disposed in the flexible raceway.

The medical treatment equipment boom 62 is composed of material, for example metal or composite material, that is sufficiently strong and durable to support any equipment, such as the medical equipment interface console 64. The boom, typically is tubular in cross-section and of sufficient volume to accommodate the various above described conduits disposed within the boom.

The boom 62 is of sufficient length to provide movement and position of the console 64 completely around the patient transport apparatus 78. The movement of the boom 62 is facilitated by one of a motor, for example an electric motor, and manually applied force.

In an exemplary embodiment of the medical equipment interface console 64, the medical equipment interface console 64 includes electrical sockets 66, fluid sockets 68, data ports 70, and video ports 80. Each of these ports are coupled to appropriate electrical, fluid, and data conduits disposed in the flexible raceway. Such conduits can be convenient and conventional conduits such as wires, optical paths, hoses, cables, and in some cases wireless communication devices. All the conduits are coupled to appropriate sources and supplies at the end of the flexible raceway 38 coupled to the support carriage 60.

The electric supply is AC and DC power to operate various medical equipment, for example, ventilator, infusion pump, stimulators and monitors, needed for a specific patient on the patient transport apparatus 78. The fluid supply is one of liquid and gas. The liquid can be intravenous fluid and medications. The gas is anesthesia gases such as oxygen, nitrogen, nitrous oxide and such other gases determined by an anesthesiologist. The data signals are from various sensors coupled to a patient and equipment associated with the patient on the patient transport apparatus 78.

The patient transport apparatus 78 (PTA) is removably coupled to the support carriage 60. The PTA may include wheels that can be selectively removed and/or retracted. In another embodiment the PTA 78 is coupled to the support carriage 60 but is not removable.

The PTA is configured to support a patient during medical treatment and in some circumstances during medical imaging. The support of the patient can be provided by, for example, a mattress, a sling system, a system of padded slats, and combinations of such support elements. Some medical imaging procedures require the patient to be transferred to a platform associated with the imaging equipment, for example some MRI machines. The PTA is also configured to support medical equipment, for example intravenous fluid stanchions, cardiac monitoring equipment, and the like. It is contemplated that when the PTA 78 is in the multimodality medical suite 20, all monitoring, support, fluid transfer, power is provided with the interface console 64 coupled to the boom 62. The PTA is composed of material that is of sufficient strength, durability, and compatibility with the medical equipment of the multimodality medical suite 20, for example stainless steel.

In one embodiment, the medical equipment is coupled directly to the PTA 78 and moves with PTA. Upon entry into the multimodality medical suite 20, the interface console 64 coupled to the equipment boom 62 and connected to the appropriate conduits disposed in the flexible raceway 36 is coupled to the PTA 78. In such case, the PTA 78 is also coupled to the support carriage 60.

In some circumstances, the PTA 78 is not coupled to the support carriage 60, but is movable between the first and second rooms 22, 24 of the multimodality medical suite 20. In those circumstances the interface console 64 and the boom 62 will move with the PTA 78 so that a patient on the PTA will still be provided with the necessary monitoring, treatment and related support apparatus. In some further circumstances the interface console 64 is configured to be coupled to electrical, fluid and data conduits available in either the first or second rooms, 22, 24.

A door control controller 72, in an exemplary embodiment of the movable door element 30, is coupled to the door 28 of the multimodality medical suite 20 and the housing 42. The door control controller 72 is configured to detect the position of the support carriage 60 wherein the controller will cause the actuator 52 to move the housing 42 to the second position 46 when the support carriage 60 moves to the second room 24 and extending the flexible raceway through the space 40 in the portion of the door 62 configured before such operation. The door control controller 72 can be mounted directly on the support carriage 60 as illustrated in FIG. 1 or it may be mounted at any convenient location within or without the multimodality medical suite 20.

The controller 72 may be a microprocessor coupled to the various apparatus of the system. The controller 72 may also be a server coupled to an array of peripherals or a desktop computer, or a laptop computer, or a smart-phone. It is also contemplated that the controller is configured to control each individual machine and may be remote from any of the apparatus. Communication between the controller 72 and the various apparatus may be either by hardwire or wireless devices. A memory/data base coupled to the controller may be remote from the controller 72. The controller 72 typically includes an input device, for example a mouse, or a keyboard, and a display device, for example a monitor screen or a smart phone. Such devices can be hardwired to the controller or connected wirelessly with appropriate software, firmware, and hardware. The display device may also include a printer coupled to the controller 72. The display device may be configured to mail or fax reports as determined by a user. The controller 72 may be coupled to a network, for example, a local area network or a wide area network, which can be one of a hardwire network and a wireless network, for example a Bluetooth network or internet network, for example, by a WIFI connection or "cloud" connection.

For purposes of this disclosure, the term "coupled" means the joining of two components (electrical or mechanical) directly or indirectly to one another. Such joining may be stationary in nature or moveable in nature. Such joining may be achieved with the two components (electrical or mechanical) and any additional intermediate members being integrally formed as a single unitary body with one another or the two components and any additional member being attached to one another. Such adjoining may be permanent in nature or alternatively be removable or releasable in nature.

Although the foregoing description of the present shielded, movable door element of a medical imaging/treatment suite has been shown and described with reference to particular embodiments and applications thereof, it has been presented for purposes of illustration and description and is not intended to be exhaustive or to limit the invention to the particular embodiments and applications disclosed. It will be apparent to those having ordinary skill in the art that a number of changes, modifications, variations, or alterations to the shielded, movable door element of a medical imaging/treatment suite as described herein may be made, none of which depart from the spirit or scope of the present disclosure. The particular embodiments and applications were chosen and described to provide the best illustration of the principles of the disclosure and its practical application to thereby enable one of ordinary skill in the art to utilize the disclosure in various embodiments and with various modifications as are suited to the particular use contemplated. All such changes, modifications, variations, and alterations should therefore be seen as being within the scope of the present disclosure as determined by the appended claims when interpreted in accordance with the breadth to which they are fairly, legally, and equitably entitled.

What is claimed is:

1. A movable door element in a door of a multimodality medical suite, the door is part of a wall positioned between a first room and a second room of the suite, with the suite including a flexible raceway configured to extend within the length of the suite between the rooms and selectively extend through a portion of the door, the door element comprising:

a housing coupled to the door and configured to selectively move from a first position to a second position, wherein the housing is further configured to move to the second position when a shield door component, coupled to the raceway, replaces the housing and is disposed in a space in the portion of the door vacated by the door element, and a shield component disposed in the housing.

2. The movable door element of claim 1, wherein the second position is at least 90° relative to the door and the door element includes an actuator configured to return the door element to the first position when the door component vacates the space originally occupied by the door element.

3. The movable door element of claim 1, wherein the second position is within a recess defined in the door, with the recess configured to receive the door element and includes an actuator configured to selectively move the door element between the first and second position relative to the door component.

4. The movable door element of claim 1, wherein the second position is a position parallel to the door and the door element includes an actuator configured to move the door element and at least return the door element to the first position when the door component vacates the space originally occupied by the door element.

5. The movable door element of claim 1, wherein the shield component is one selected from a group consisting of a radiation shield, a radio frequency shield, an acoustic shield, a gas seal, and a combination of any two such shield components.

6. The movable door element of claim 2, wherein the actuator is one of a spring, a pneumatic cylinder, a hydraulic cylinder, and a motor.

7. The movable door element of claim 3, wherein the actuator is one of a spring, a pneumatic cylinder, a hydraulic cylinder, and a motor.

8. The movable door element of claim 4, wherein the actuator is one of a spring, a pneumatic cylinder, a hydraulic cylinder, and a motor.

9. The movable door element of claim 1, further comprising a patient transport system, with the patient transport system comprising:

a track system extending within the first and second rooms of the suite;

a support carriage coupled to the track system and configured to move between the first and second rooms of the suite, wherein one end of the flexible raceway is coupled to the support carriage.

10. The movable door element of claim 1, further comprising a medical treatment equipment boom coupled to the flexible raceway and configured to move between the first and second room of the suite.

11. The movable door element of claim 10 including a medical equipment interface console coupled to the medical treatment equipment boom, with the console further coupled to electrical, fluid, and data conduits disposed in the flexible raceway.

12. The movable door element of claim 1, further comprising a door control controller coupled to the door of the suite and the housing, and configured to detect the position of the support carriage, wherein the controller will move the housing to the second position when the support carriage moves to the second room.

13. A method for maintaining shield integrity of a multimodality medical suite, with the suite including a first room and a second room separated by a wall having a door, with the suite further including a flexible raceway configured to extend within the length of the suite and selectively extend through a portion of the door, the method comprising:

providing a door element, the door element comprising:

a housing coupled to the door and configured to selectively move from a first position to a second position; and a shield component disposed in the housing;

providing a shield door component;

coupling the shield door component to the flexible raceway;

positioning the shield door component along the flexible raceway so that the shield door component moves the housing from the portion of the door when the flexible raceway is extended between the two rooms of the suite; and disposing the shield door component in a space in the portion of the door vacated by the door element, wherein the shield integrity of the suite is maintained.

14. The method for maintaining shield integrity of a multimodality medical suite of claim 13, further comprising returning the door element to the first position when the door component vacates the space originally occupied by the door element, wherein an actuator is coupled to the door element and provides a force to selectively move the door element.

15. The method for maintaining shield integrity of a multimodality medical suite of claim 13, wherein the second position is within a recess defined in the door, with the recess configured to receive the door element and includes an actuator configured to selectively move the door element between the first and second position relative to the door component.

16. The method for maintaining shield integrity of claim 13, wherein the second position is a position parallel to the door and the door element includes an actuator configured to move the door element and at least return the door element to the first position when the door component vacates the space originally occupied by the door element.

17. The method for maintaining shield integrity of a multimodality medical suite of claim 13, further comprising selecting the shield component from a group consisting of a radiation shield, a radio frequency shield, an acoustic shield, a gas seal, and a combination of any two such shield components.

18. The method for maintaining shield integrity of a multimodality medical suite of claim 14, wherein the actuator is one of a spring, a pneumatic cylinder, a hydraulic cylinder, and a motor.

19. The method for maintaining shield integrity of a multimodality medical suite of claim 15, wherein the actuator is one of a spring, a pneumatic cylinder, a hydraulic cylinder, and a motor.

20. The method for maintaining shield integrity of a multimodality medical suite of claim 16, wherein the actuator is one of a spring, a pneumatic cylinder, a hydraulic cylinder, and a motor.

21. The method for maintaining shield integrity of a multimodality medical suite of claim 13, further comprising:

providing a patient transport system, with the patient transport system comprising:

a track system extending within the first and second rooms of the suite; and a support carriage coupled to the track system and configured to move between the first and second rooms of the suite, wherein one end of the flexible raceway is coupled to the support carriage; and moving the support carriage between the first room and second room along the track system.

22. The method for maintaining shield integrity of a multimodality medical suite of claim 21, further comprising:

providing a medical treatment equipment boom coupled to the flexible raceway and the support carriage; and moving the medical treatment equipment boom between the first room and second room.

23. The method for maintaining shield integrity of a multimodality medical suite of claim 22, further comprising:

providing a medical equipment interface console coupled to the medical treatment equipment boom, and coupling the console to electrical, fluid, and data conduits disposed in the flexible raceway.

24. The method for maintaining shield integrity of a multimodality medical suite of claim 13, further comprising:

providing a door control controller;

coupling the controller to the door of the suite and the housing, with the controller configured to detect the position of the support carriage; and moving the housing to the second position when the controller detects that the support carriage moves to the second room.

25. A movable door element in a door of a multimodality medical suite, the door is part of a wall positioned between a first room and a second room of the suite, with the suite including a flexible raceway configured to extend within the length of the suite between the rooms and selectively extend through a portion of the door, the door element comprising:

a housing coupled to the door and configured to selectively move from a first position to a second position, wherein the housing is further configured to move in response to the proximity of a shield door component coupled to the raceway and which replaces the housing in a space in the portion of the door vacated by the door element, and a shield component disposed in the housing.

26. The movable door element of claim 25, wherein the second position is at least 90° relative to the door and the door element includes an actuator configured to return the door element to the first position when the door component vacates the space originally occupied by the door element.

27. The movable door element of claim 25, wherein the second position is within a recess defined in the door, with the recess configured to receive the door element and includes an actuator configured to selectively move the door element between the first and second position relative to the door component.

28. The movable door element of claim 25, wherein the second position is a position parallel to the door and the door element includes an actuator configured to move the door element and at least return the door element to the first position when the door component vacates the space originally occupied by the door element.

29. The movable door element of claim 25, wherein the shield component is one selected from a group consisting of a radiation shield, a radio frequency shield, an acoustic shield, a gas seal, and a combination of any two such shield components.

30. The movable door element of claim 26, wherein the actuator is one of a spring, a pneumatic cylinder, a hydraulic cylinder, and a motor.

31. The movable door element of claim 27, wherein the actuator is one of a spring, a pneumatic cylinder, a hydraulic cylinder, and a motor.

32. The movable door element of claim 28, wherein the actuator is one of a spring, a pneumatic cylinder, a hydraulic cylinder, and a motor.

33. The movable door element of claim 25, further comprising a patient transport system, with the patient transport system comprising:

a track system extending within the first and second rooms of the suite;

a support carriage coupled to the track system and configured to move between the first and second rooms of the suite, wherein one end of the flexible raceway is coupled to the support carriage.

34. The movable door element of claim 25, further comprising a medical treatment equipment boom coupled to the flexible raceway and configured to move between the first and second room of the suite.

35. The movable door element of claim 34 including a medical equipment interface console coupled to the medical treatment equipment boom, with the console further coupled to electrical, fluid, and data conduits disposed in the flexible raceway.

* * * * *